US008607842B2

(12) United States Patent
Drifka

(10) Patent No.: US 8,607,842 B2
(45) Date of Patent: Dec. 17, 2013

(54) DEVICE AND METHOD FOR INCREASING THE WIND LOAD RESISTANCE AND DISENGAGE-ABILITY OF OVERHEAD ROLL-UP DOORS

(75) Inventor: Brian Norbert Drifka, Richfield, WI (US)

(73) Assignee: Rytec Corporation, Jackson, WI (US)

( * ) Notice: Subject to any disclaimer, the term of this patent is extended or adjusted under 35 U.S.C. 154(b) by 0 days.

(21) Appl. No.: 13/270,743

(22) Filed: Oct. 11, 2011

(65) Prior Publication Data

US 2012/0241109 A1 Sep. 27, 2012

Related U.S. Application Data

(60) Provisional application No. 61/466,754, filed on Mar. 23, 2011.

(51) Int. Cl.
*E06B 9/17* (2006.01)

(52) U.S. Cl.
USPC ..... 160/274; 160/290.1; 160/268.1; 160/266

(58) Field of Classification Search
USPC ..... 160/290.1, 268.1, 267.1, 274, 275, 271, 160/208, 266, 201
See application file for complete search history.

(56) References Cited

U.S. PATENT DOCUMENTS

| | | | | |
|---|---|---|---|---|
| 755,675 A | | 3/1904 | Kirby, Jr. | |
| 1,405,618 A | | 2/1922 | Nelson | |
| 1,749,180 A | | 3/1930 | Dixson | |
| 1,764,880 A | | 6/1930 | Nelson | |
| 1,766,730 A | | 6/1930 | Traut | |
| 1,796,760 A | | 3/1931 | Norquist et al. | |
| 1,832,387 A | * | 11/1931 | Hansen | 160/271 |
| 1,866,788 A | * | 7/1932 | Arthur | 160/275 |
| 1,914,431 A | | 6/1933 | Jacobs et al. | |
| 1,925,578 A | | 9/1933 | Traut | |
| 1,972,182 A | | 9/1934 | Chamberlain, Jr. et al. | |
| 2,126,782 A | | 8/1938 | Julien | |
| 3,421,568 A | | 1/1969 | Youngs | |

(Continued)

FOREIGN PATENT DOCUMENTS

GB 2108839 A 5/1983

OTHER PUBLICATIONS

International Search Report and Written Opinion for International Application No. PCT/US2012/024271 dated May 23, 2012, 20 pages.

*Primary Examiner* — Blair M. Johnson
(74) *Attorney, Agent, or Firm* — Factor Intellectual Property Law Group, Ltd.

(57) ABSTRACT

A door assembly having a flexible door panel wound and unwound on a drum or the like to selectively block or permit access through an opening, the flexible door panel having a stiffness, a width, and a length. The door assembly further includes vertically extending side columns disposed on opposite sides of the opening, the side columns being configured to engage a marginal edge of the flexible panel to vertically guide the panel while opening or closing. Attached to a leading edge of the door panel is a bottom bar having a greater stiffness than the door panel and a narrower width than a distance between the vertical panel guide assemblies. Bottom bar guides are disposed proximate a lower portion of the opening and are configured to engage a portion of the bottom bar only when the bottom bar is located in at least a partially closed position.

20 Claims, 5 Drawing Sheets

(56) References Cited

U.S. PATENT DOCUMENTS

| | | | | | |
|---|---|---|---|---|---|
| 4,357,978 | A | * | 11/1982 | Keller et al. | 160/41 |
| 4,586,552 | A | | 5/1986 | Labelle | |
| 4,601,320 | A | | 7/1986 | Taylor | |
| 4,884,617 | A | | 12/1989 | Coenraets | |
| 5,090,468 | A | | 2/1992 | Tedeschi | |
| 5,271,448 | A | | 12/1993 | Delgado | |
| 5,601,133 | A | | 2/1997 | Krupke et al. | |
| 5,632,317 | A | | 5/1997 | Krupke et al. | |
| 5,720,333 | A | * | 2/1998 | Turvey | 160/290.1 |
| 6,247,517 | B1 | | 6/2001 | Drifka et al. | |
| 6,390,171 | B2 | | 5/2002 | Drifka et al. | |
| 6,574,832 | B1 | | 6/2003 | Boerger et al. | |
| 6,915,832 | B2 | * | 7/2005 | Stern, Jr. | 160/205 |
| 6,959,748 | B2 | | 11/2005 | Hudoba | |
| 7,036,549 | B2 | | 5/2006 | Coenraets | |
| 7,131,481 | B2 | | 11/2006 | Varley et al. | |
| 7,762,304 | B2 | | 7/2010 | La Marca et al. | |
| 2003/0079845 | A1 | * | 5/2003 | Stern, Jr. | 160/201 |
| 2006/0144530 | A1 | | 7/2006 | Nagare et al. | |
| 2010/0032105 | A1 | | 2/2010 | Drifka | |
| 2012/0241110 | A1 | * | 9/2012 | Drifka et al. | 160/271 |

* cited by examiner

DEVICE AND METHOD FOR INCREASING THE WIND LOAD RESISTANCE AND DISENGAGE-ABILITY OF OVERHEAD ROLL-UP DOORS

RELATED APPLICATIONS

This application claims priority to U.S. Provisional Application Ser. No. 61/466,754 entitled "Device and Method for Increasing the Wind Load Resistance and Disengage-ability of Overhead Roll-up Doors" filed Mar. 23, 2011, the contents of which are fully incorporated herein by reference.

FIELD OF THE INVENTION

The present invention is related to overhead roll-up doors, and more specifically to a device and method for increasing the wind load resistance of the door while enhancing the ability of the door and its components to disengage from a guided path if the door and/or its components are impacted by an object imparting a transverse force when the door is opening or closing.

BACKGROUND OF THE INVENTION

Overhead roll-up doors provide resistance to high winds or wind loads and/or air pressure applied to a door panel when in a partially or fully closed position. These doors are typically guided up and down in side columns or vertical guide assemblies which include a vertical path of travel for the door panel which selectively permits and prohibits access to an opening or passageway. Wind load when the door is in a substantially closed or fully closed position is particularly problematic, because as is known in the art, the wind load increases as the door panel approaches a fully closed position. As more of the door panel is exposed, a greater surface area of the door panel may become "impacted" by the wind creating the load, thereby dramatically increasing the total load on the door.

In addition to having to account for wind load resistance, these doors may also be installed in high-traffic areas with the potential to be impacted by objects when the door is opening or closing—a necessitating that the door panel maintain a particular level of breakaway-ability in response to such an impact. In order to avoid damage to the door (from, for example, the surrounding structure, individuals near the door, and any objects striking the door), overhead roll-up door panels are typically designed to disengage from the side columns and deviate from the path of travel when impacted by an external force to either a front or back face of the door panel. While impacts may occur at any point while the door is opening or closing, typically these impacts occur at heights greater than two to four feet as the door is opening or closing as individuals or objects attempt to sneak under a closing door or approach an opening door too quickly before it is out of the passageway.

In order to provide rigidity to the door panel, facilitate the proper travel of the door panel in the vertical path, and provide additional resistance to wind load (or air pressure) and other external impacts, overhead roll-up doors may include a weighted "bottom bar" attached proximate a lower or leading edge of the door panel. Such bottom bars typically extend horizontally across the bottom of the door panel a distance approximately 1"-2" less than the distance between the side columns and a distance approximately 2"-6" less than the width of the door panel. In an attempt to further enhance wind load resistance and guidance and engagement with the side columns, bottom bars may include an extension, like for example flexible ultra-high molecular weight ("UHMW") plastic tabs, that extend into the vertical path of travel, engaging the side columns. These tabs are typically designed to be rigid enough to provide some resistance to air pressure, however, they must be flexible enough to allow the bottom bar to disengage from the side columns should an object impact the bottom bar or door panel. If these tabs are too flexible they may not hold up under high winds, i.e. may lead to the door becoming disengaged, even in a substantially closed position, from wind or air pressure. Conversely, if the tabs are too rigid, the bottom bar, side columns, or door panel could be damaged if the bottom bar or door panel is impacted by an object, inasmuch as the tabs may fail to release from the side columns upon impact. This inverse relationship can make door design difficult, especially in high wind or high pressure/impact areas—particularly where substantial traffic frequently passes through the opening blocked and unblocked by the door panel.

Regardless of whether the tabs are made to be highly flexible or extremely rigid, objects imparting a great force on the door panel or bottom bar may break the tabs completely away from bottom bar, requiring replacement of the tabs or possibly even the entire bottom bar in order to fully realize the guidance and wind load resistance capabilities of the bottom bar and door panel. In doors where engagement between the tabs and side columns is relied on to provide much of the wind load resistance, the breaking away of the tabs may lead to the door having unsatisfactory wind load resistance capabilities and creating unwanted blow out resulting from normal or even light wind loads.

In some door designs, in addition or instead of tabs, the bottom bar may include a structural steel angle or pivot to increase the flexibility of the bottom bar and/or further facilitate the dislodgment of the bottom bar and door panel should the bottom bar or door panel be impacted by an object. The angle may include, for example, a notch in the middle, and utilize a piece of flat bar and two sheer pins to provide rigidity and resistance to wind and maintain the shape of the bottom bar as the door panel opens and closes. If impacted, however, the sheer pins may break, allowing the bottom bar to bend at the notch and succumb to external forces, for example wind, even when in the substantially closed position. In order to prevent dislodgement of the door panel and/or bottom bar from a wind force once the sheer pins are broke, the bottom bar must be bent back into place and the sheer pins must be replaced.

Therefore, it would be advantageous to provide a device and method capable of providing an overhead roll-up door with satisfactory wind load resistance, particularly when the door panel is substantially or fully closed when the wind load is highest, while providing maximum breakaway-ability of the door panel if any of the door components are impacted.

It would be further advantageous if the device and method contained minimal parts which may otherwise need replacement or repair resulting from breakage because of impact by objects striking the door.

The present invention is directed to solving these and other problems.

SUMMARY OF THE INVENTION

The present invention is directed to a device and method for increasing wind load resistance of an overhead roll-up door, particularly when the door panel is in a substantially closed position, while enhancing the ability of the door and its components to disengage from the side columns and/or vertical panel guide assembly if the door or its components are impacted by a force when the door is opening or closing.

According to one aspect of the invention, a door assembly having a drum for winding and unwinding a flexible door panel having a width and length to permit and prohibit access through an opening is provided. The door assembly includes side columns or vertical panel guide assemblies (referred to herein as "side columns" or "vertical guides") substantially parallel to each other, the side columns spaced apart a first distance and being disposed on opposite sides of the opening. Each of the side columns define a vertical path of travel and are configured to engage a marginal edge of the door panel as the door panel is raised and lowered.

According to another aspect of the invention, in order to enhance the stiffness and wind load resistance of the door panel, attached proximate a leading or bottom edge of the door panel is a bottom bar having a greater stiffness, and in some embodiments a greater thickness, than the door panel. The bottom bar may be configured to have a width extending transversally across the leading or bottom edge of the door panel a second distance less than the first distance between the side columns to prevent the engagement of the bottom bar and the side columns as the door panel opens, closes, or stops in a fully or partially closed position.

According to still another aspect of the invention, in order to further increase the wind load resistance of the door as the door panel approaches a substantially closed position, bottom bar guides capable of engaging and receiving at least a portion of the bottom bar may be disposed proximate a lower portion of the opening. The bottom bar guides may include a front body, a back body, and a vertical channel there between for receiving and engaging at least a portion of the bottom bar. The bottom bar guides may be made of a rigid material, which when engaging at least a portion of the bottom bar, holds the bottom bar in place and prevents it from disengaging therewith in the event the door panel experiences a high wind load or air pressure.

According to yet another aspect of the invention, the bottom bar guides may extend vertically from a lowermost portion of the opening a desired distance less than the vertical guides, and in preferred embodiments a distance less than or equal to 24 inches. The vertical height of 24 inches for the bottom bar guides is preferred because a distance of 24 inches between the bottom bar and lowermost portion of the opening provides enough room for the wind and air pressure to escape underneath the door panel to help insure that the bottom bar does not deviate too far from the closing path and can easily engage the bottom bar guides as the door closes. Extending the bottom bar guides a shorter vertical distance also helps prevent the locking of bottom bar to facilitate the disengagement of the door panel and bottom bar from the vertical guides if either are impacted by an object during a substantial portion of the opening and closing sequence.

According to another aspect of the invention, the bottom bar guides may be attached to a surface forming a lower boundary of the opening, like for example a floor, threshold, or ledge, or alternatively may be attached directly to a lower portion of the side columns themselves.

According to another aspect of the invention, the bottom bar guides may be attached such that the channel within the bottom bar guides substantially aligns with the vertical path of travel defined for the door panel by the vertical guides.

In another aspect of the invention the bottom bar guides may further include an angled face on at least a portion of the first or second bodies. The angled face(s) may be angled with respect to a plane defined by the door panel or a portion of the opening, and should be angled sufficiently to deflect any impacts to the bottom bar guides resulting from objects which may pass through the opening, like for example machines or vehicles.

In yet another aspect of the invention, a top portion of each of the bottom bar guides may be angled outward from the bottom bar and/or door panel. These angled top portions may form a funnel or "Y" shape in order to facilitate entry of the bottom bar into the channel formed within the bottom bar guides. The angled top portions preferably extend a distance required to "capture" and engage bottom bars which have been blown outside the ordinary path of travel due to wind or pressure as the door panel is moved to the closed position.

According to another aspect of the invention, the bottom bar guides may further include a connector for holding the first and second faces of the bottom bar guides together, enhancing the rigidity of the bottom bar guides, and therefore enhancing the wind load resistance of the door when the door panel is in at least a substantially closed position. The connector may be, for example, a bolt or screw, which extends through the entire bottom bar guides and prevents the bottom bar guides from deforming from pressure which is applied by the bottom bar on the bottom bar guides as a result of wind or air pressure on either side of the door panel.

According to another aspect of the invention, the bottom bar may include at least one end tab extending horizontally from at least one edge, and more preferably two edges, of the bottom bar. Each tab extending from an edge of the bottom bar may be the only portion of the bottom bar which engages the bottom bar guides. The total width of the bottom bar with at least one end tab extending horizontally from at least one or two edges should be less than the first distance between the side columns.

As should be appreciated by those having ordinary skill in the art, while narrower than the distance of the vertical guides, the width of the bottom bar with or without end tabs should remain sufficient to allow at least a portion of the bottom bar to engage the bottom bar guides when the door panel is in at least a substantially closed position. In order to accomplish this, the bottom bar guides should be disposed between the guide assemblies. Configuring the door assembly in this manner allows the bottom bar to travel between the open and closed positions, substantially free of any encumbrances, eliminating any engagement between the bottom bar and the guide assemblies, thereby minimizing any damage to the door panel, the bottom bar, and the guide assemblies resulting from an impact from an object. Since the total width of the bottom bar, including any end tabs, is less than the distance between the guide assemblies, the bottom bar and any associated end tabs may be made more rigid than standard bottom bars because the bottom bar does not have to disengage from the guide assemblies if the bottom bar or door panel is impacted. As should be appreciated, increasing the rigidity of the bottom bar increases the wind load resistance capabilities of the door when the bottom bar is engaged with the bottom bar guides when the door panel is in the substantially closed position.

According to another aspect of the invention, any end tabs extending horizontally from an edge of the bottom bar may be more rigid than the bottom bar itself.

According to another aspect of the invention, any tabs extending from an edge of the bottom bar may be thicker than the door panel while being thinner than the bottom bar.

According to another aspect of the invention, the door panel may be constructed from rubber or other stiffer materials in order establish enough wind resistance during the opening and closing sequence when the bottom bar is not engaged with the bottom bar guides. However, as should be appreciated by those having ordinary skill in the art, the door panel may be constructed of any material, so long as the material, either through its compositional properties or thickness, provides sufficient resistance to the wind load imposed on the door panel during the opening and closing sequence when the bottom bar is not engaged with the bottom bar guides.

Other aspects and features of the invention will become apparent to those having ordinarily skill in the art upon review of the following Description, Claims, and associated Drawings.

DETAILED DESCRIPTION OF THE PRESENT INVENTION

Figure 1:
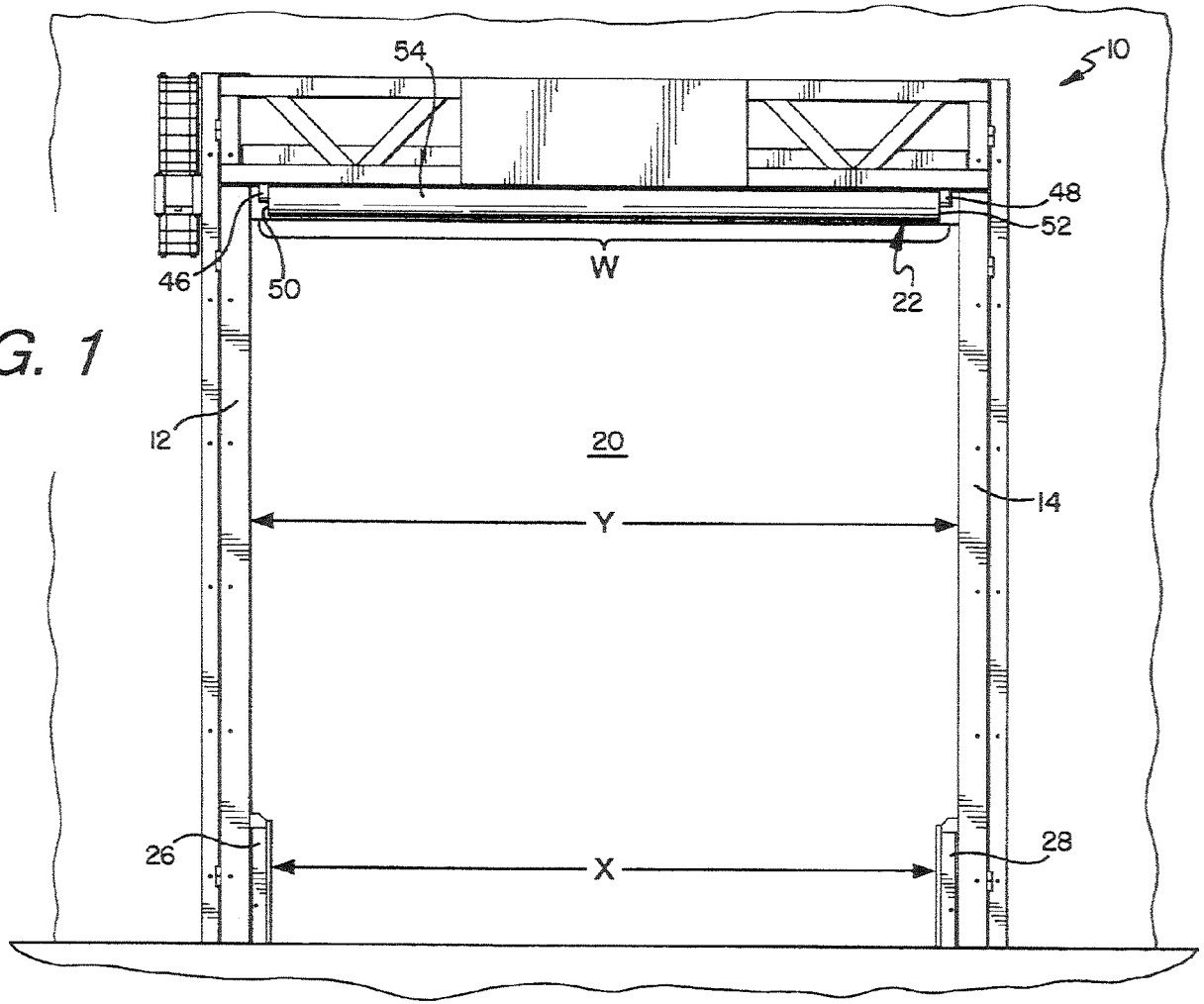
FIG. 1 is a front view of a door assembly as contemplated by the invention with a door panel in a substantially open position.

While the present invention is susceptible of embodiment in many different forms, there is shown in the drawings and will herein be described in detail, preferred embodiments of the invention with the understanding that the present disclosure is to be considered as an exemplification of the principles of the invention and is not intended to limit the broad aspect of the invention to the embodiments illustrated.

Figure 2:
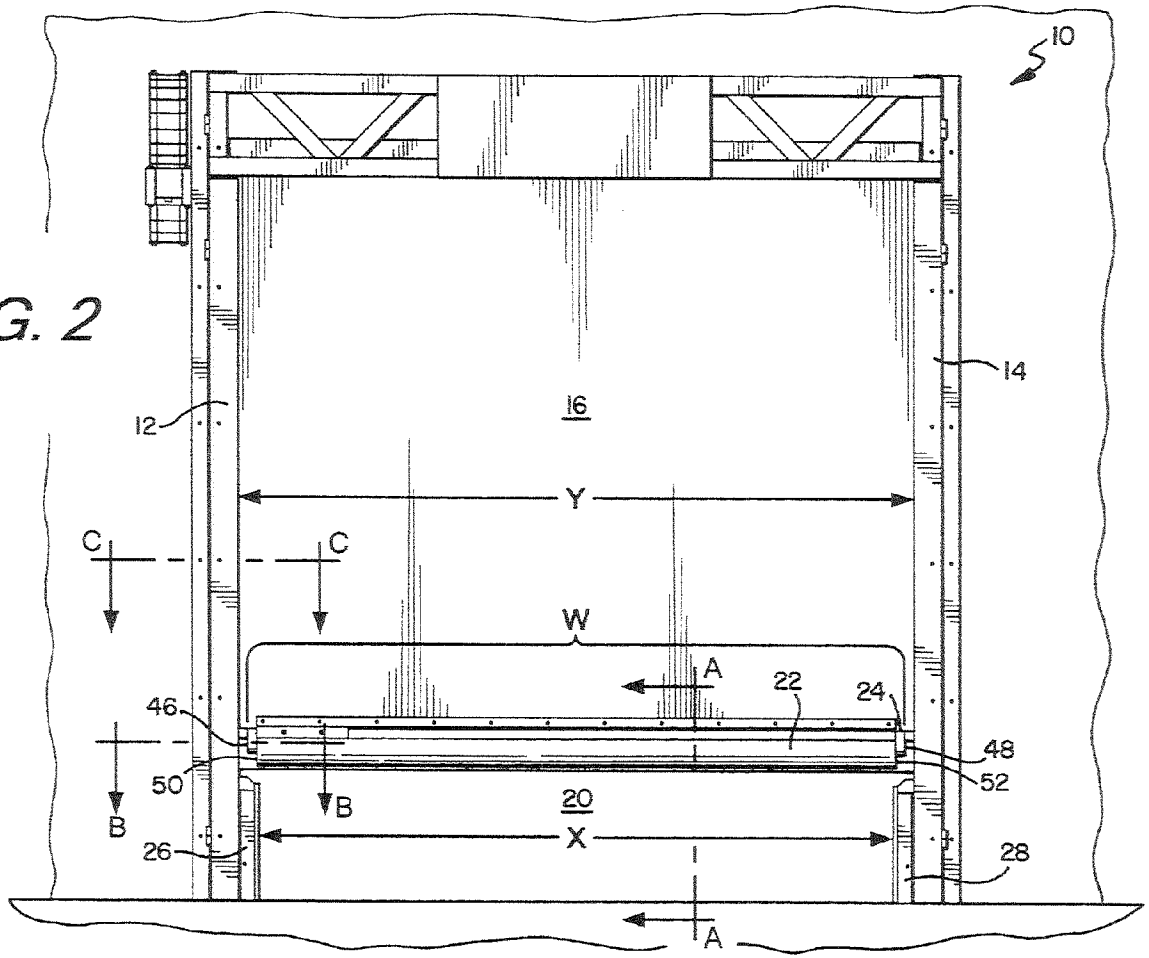
FIG. 2 is a front view of a door assembly as contemplated by the invention with a door panel in a partially opened position.
Figure 6:
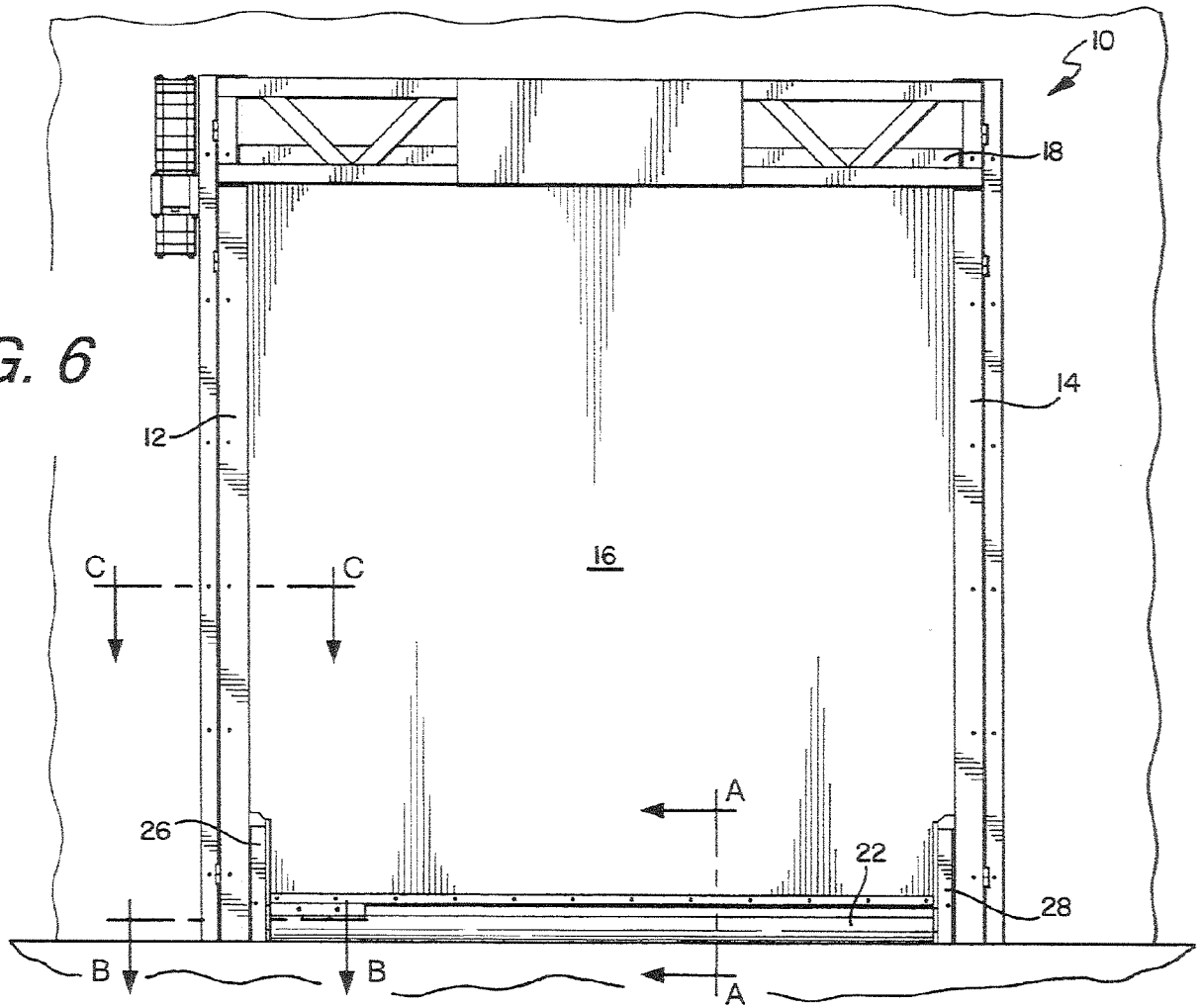
FIG. 6 is a front view of a door assembly as contemplated by the invention with a door panel in a substantially closed position.

FIGS. 1, 2, and 6 show a door assembly 10 in a substantially open position, partially closed position, and substantially closed position, respectively. Door assembly 10 includes side columns 12, 14, flexible door panel 16, drum 18 for winding and unwinding flexible door panel 16 to permit and prohibit access to opening 20, bottom bar 22 attached proximate leading or bottom edge 24 of door panel 16, and bottom bar guides 26, 28 disposed proximate a lower portion of opening 20.

It is contemplated by the invention that bottom bar 22 may be any bottom bar structure known in the art and may incorporate any desirable features known to be used with bottom bar structures in overhead roll-up doors. For example, bottom bar 22 may include a safety edge or other structure capable of deforming if bottom bar 22 is lowered on an object as a result of door panel 16 closing. Alternatively, bottom bar 22 may include a sensor or sensors capable of detecting an impact on the bottom bar and providing a signal to a motor or control circuitry for the overhead door to immediately open door panel 16 in response to the impact. Sensors which are known in the art include, but are not limited to sensors capable of detecting objects impacting a front or back face of the bottom bar, or capable of detecting objects which have been struck by a lower edge of the bottom bar that the door panel has closed on top of. As a further alternative, the lower edge of bottom bar 22 may include a motion detection sensor or the like capable of detecting motion underneath the door panel as it closes, the sensor capable of providing a signal to a motor or control circuitry for the door to prevent the door panel from closing further until no motion is detected.

Figure 3:
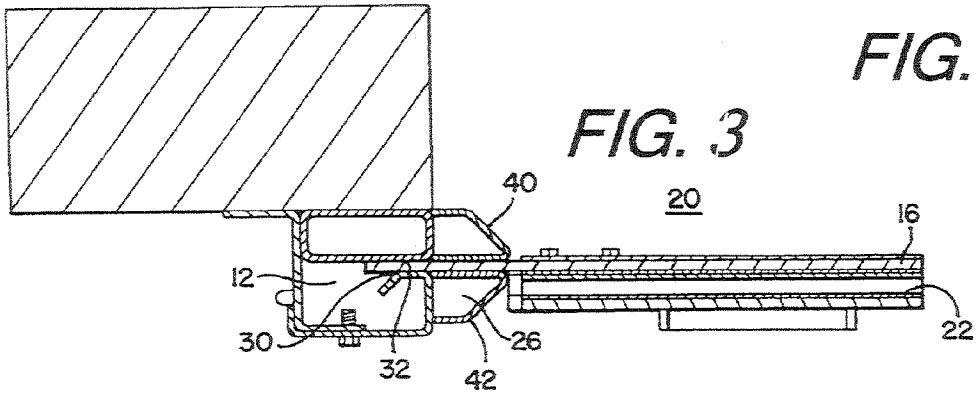
FIG. 3 is a cross-sectional view taken along the line C-C in FIG. 2.
Figure 7:
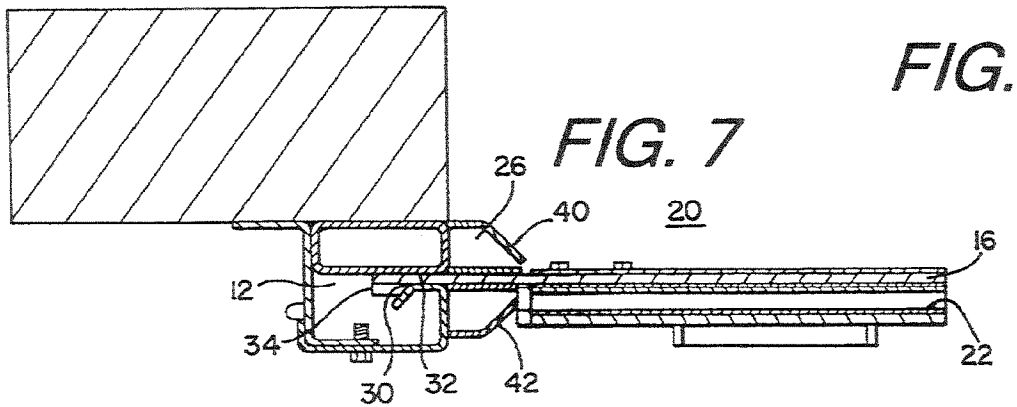
FIG. 7 is a cross-sectional view taken along the line C-C in FIG. 6.

Side columns 12, 14 are disposed on opposite sides of opening 20 and extend parallel to each other a vertical distance along substantially the entire height of opening 20. As seen in FIGS. 3 and 7, which are cross-sections along lines C-C in FIGS. 2 and 6, respectively, side column 12 contains path 30 which allows side column 12 to engage door panel 16, and defines a vertical path of travel for marginal edge 32 of flexible door panel 16 when door panel 16 is either opening, closing, or in a substantially closed position. Though only shown in a single position in FIG. 3, it should be appreciated by those having ordinary skill in the art that the relationship between side column 12, path 30, and marginal edge 32 of door panel 16 remains constant throughout the entire opening and closing sequence. Though not shown, the relationship shown in FIG. 3 for side column 12 is substantially a mirror image of the relationship of side column 14, door panel 16, and a corresponding path and marginal edge contained therein on the opposite side of opening 20.

As seen in FIG. 7, in alternative embodiments of the invention, thickened edge 34 may be attached proximate marginal edge 32 of door panel 16. Thickened edge 34 may interact with side columns 12, 14 to enhance the wind load resistance of door assembly 10 while door panel 16 is opening or closing. As should be appreciated by those having ordinary skill in the art, thickened edge 34 may be attached to marginal edge 32 as either a continuous body, or more preferably, as a segmented body leaving gaps, i.e. exposed portions of marginal edge 32, between thickened edges 34. Segmenting thickened edges 34 provide a substantially increased wind load resistance for door assembly 10 while door panel 16 is opening or closing, while providing less resistance for door panel 16 to disengage from side columns 12, 14 should door panel 16 or bottom bar 22 be impacted by an external force while door panel 16 is opening or closing.

In some alternative embodiments, a continuous thickened edge wind lock may be used wherein the edge contains at least two portions having different durometers and/or at least a portion of the face of the thickened edge contains at least two ribs and one groove or channel located there between. Utilizing different durometers and/or rib structures on a face of the thickened edge will help to facilitate the wind load resistance of the door panel while also providing the door panel the ability to disengage from the side columns should it be impacted by an object.

As is seen in FIGS. 2 and 6, bottom bar guides 26, 28 are configured to be capable of engaging bottom bar 22 when door panel 16 is in at least a substantially closed position. Though bottom bar guides 26, 28 are shown in FIGS. 1, 2, and 6 as being disposed on opposite sides of opening 20, bottom bar guides 26, 28 may be disposed at any point along opening 20 wherein they will engage bottom bar 22 when door panel 16 is in a substantially closed position. In the preferred embodiment, however, bottom bar guides 26, 28 extend vertically on opposite sides of the opening, just inside, and parallel to side columns 12, 14. As should be appreciated by those having ordinary skill in the art, the closer to the outside of opening 20 bottom bar guides 26, 28 are located, the larger the pathway for passing through opening 20 is when door panel 16 is in a partially or substantially open position.

Regardless of whether bottom bar guides 26, 28 are attached proximate opposing sides of opening 20, they may be attached to any structure which will allow them to engage bottom bar 22 when door panel 16 is in a substantially closed position. For example, bottom bar guides may be attached to a surface forming a lower boundary of the opening, like for example a floor, threshold, or ledge, or alternatively may be attached directly to side columns 12, 14.

While bottom bar guides 26, 28 may be any height which allows them to fully engage bottom bar 22 when door panel 16 is in at least a substantially closed position, as shown in FIGS. 1, 2, and 6, it is preferable that bottom bar guides 26, 28 extend vertically a distance less than side columns 12, 14, and more preferably a distance equal to or less than 24 inches. The height of bottom bar guides 26, 28 may be set at any desired level to allow bottom bar 22 to travel free and loose after a desired height, thereby minimizing any damage incurred should an object impact the door panel 16 and/or bottom bar 22.

As should be appreciated by those having ordinary skill in the art, the height of bottom bar guides 26, 28 may be adjusted to meet the requirements of the door installation. However, it should be appreciated that the vertical height of bottom bar guides 26, 28 directly affects the increase in wind load resistance of the door and the disengage-ability of the door in an inverse ratio. As the vertical height of bottom bar guides 26, 28 increase, the wind load resistance of door assembly 10 may substantially increase along a greater portion of the path of travel of door panel 16, e.g. two feet of increased wind load resistance from bottom bar 22 and bottom bar guides 26, 28 engaging versus four feet of increased wind load resistance, and better insures the capture of bottom bar 22 by bottom bar guides 26, 28 because the bottom bar will be captured at an earlier point in the closing sequence before wind, for example, blows the bottom bar out of alignment with the bottom bar guides and path 30 contained therein. However, increasing the height of the bottom bar guides inhibits the disengage-ability of door panel 16 and bottom bar 22 if impacted substantially along a portion of the path of travel the bottom bar guides are extended along. Conversely, as the vertical distance of the bottom bar guides decrease, the wind load resistance of the door panel substantially decreases along a greater portion of the path of travel of the door panel while the disengage-ability of the door and its components if impacted along a greater portion of the path of travel increases.

In order to combat this inverse relationship and combat the loss of disengage-ability in the face of increased wind load resistance, it is contemplated by the invention that bottom bar guides 26, 28 may be made of a flexible or a combination of a flexible and rigid material. For example, if bottom bar guides 26, 28 extend vertically a distance of 24 inches from the lower boundary of the opening, it is contemplated that the first 18 inches of the bottom bar guides engaged by bottom bar 22 may be made of a semi-flexible material, while the last 6 inches of bottom bar guides 26, 28 engaged by bottom bar 22 may be made of a rigid material. Utilizing flexible and rigid materials allows for the benefits of aligning the bottom bar in the bottom bar guides and preventing blowout as the wind load on door panel 16 is increased as it approaches the closed position while still maintaining the disengage-ability of door panel 16 and bottom bar 22 if impacted by an object when the bottom bar is engaged by the flexible portion of the bottom bar guides.

As should be appreciated by those having ordinary skill in the art, utilizing bottom bar guides having different flexibilities or rigidities is particularly advantageous where wind load resistance is of the utmost importance in high traffic areas. By utilizing differing flexibilities or rigidities, bottom bar guides 26, 28 may be a greater vertical height, like for example four, six, eight or ten feet rather than two feet, so a portion of bottom bar 22 may engage bottom bar guides 26, 28 to insure alignment of bottom bar 22 with guides 26, 28 and to prevent door panel 16 from blowing out of side columns 12, 14 or bottom bar 22 out of alignment with guides 26, 28—because the more flexible bottom bar guide portions may flex and allow bottom bar 22 to escape if an object impacts door panel 16 or bottom bar 22.

In order to achieve the differing flexibilities in portions of bottom bar guides 26, 28, it is contemplated by the invention that different materials may be used to form bottom bar guides 26, 28, like for example a flexible plastic and a rigid metal. Alternatively, the same material may used but treated or given different qualities to insure that one portion of the bottom bar guides 26, 28 are more flexible than another. For example, bottom bar guides 26, 28 may be made entirely of metal, however a portion may be treated with a chemical or impregnated with an additive which increases the flexibility of the metal, while another portion may be treated with a chemical or impregnated with an additive which increases the rigidity of the metal. As yet a further alternative, bottom bar guides 26, 28 may be made of differing or increasing thicknesses from the vertical high point on bottom bar guides 26, 28 to a point proximate the lower most portion of the guides. As yet a further alternative, a lower portion of bottom bar guides 26, 28 may include an additional or separate structure as part of the guide or attached thereto to increase the rigidity. It is also contemplated that the same or different types of metals be used with varying flexibility characteristics. Indeed, any means of altering the flexibility and/or rigidity of bottom bar guides 26, 28 may be used in order to created a guide which is flexible in at least one portion while being less flexible (more rigid) in at least one portion.

Figure 5:
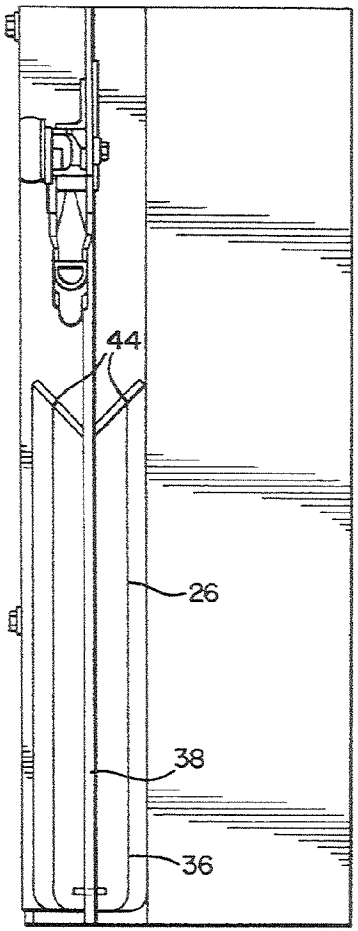
FIG. 5 is a cross-sectional view taken along the line A-A in FIG. 2.
Figure 4:
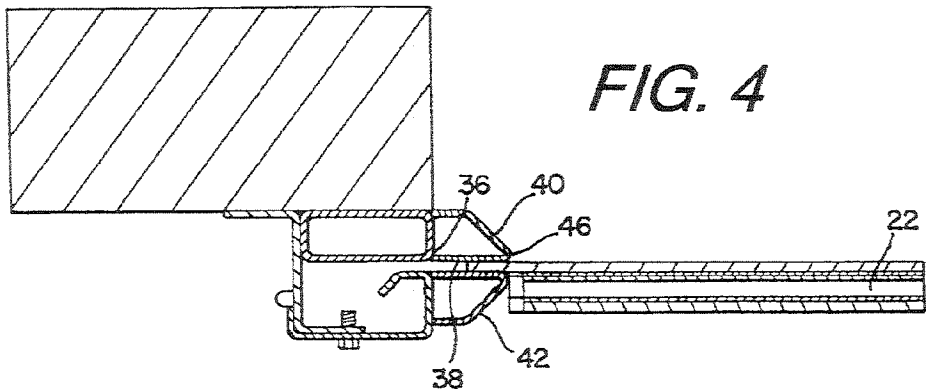
FIG. 4 is a cross-sectional view taken along the line B-B in FIG. 2.
Figure 8:
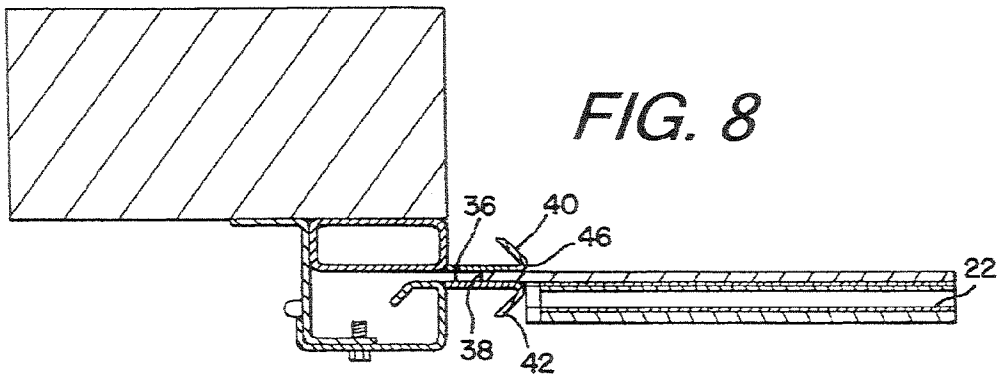
FIG. 8 is a cross-sectional view taken along the line B-B in FIG. 6.

In order to enhance the rigidity of bottom bar guides 26, 28, and therefore enhance the wind load resistance of door assembly 10, bottom bar guides 26, 28 may further include a connector 36 to hold a front portion or body of the guide together with a back portion or body of the guide. As seen in FIGS. 4 and 8, which are cross-sections along lines B-B in FIGS. 2 and 6, for example, connector 36 may cross a channel 38 located on the interior of bottom bar guides 26, 28. Since channel 38 receives and guides bottom bar 22 when door panel 16 is in a substantially closed position, and depending on the height of the bottom bar guides 26, 28 the channel may also receive a portion of door panel 16 above bottom bar 22, as seen in FIG. 5, (which is a cross-section along line C-C in FIG. 2), it is preferable to place connector 36 at as low a point vertically as possible while still recognizing the effects of connector 36. Alternatively, or additionally, it may be advantageous to place connector 36 on an interior portion of bottom bar guides 26, 28 proximate side columns 12, 14 where bottom bar 22 does not extend. For example, if bottom bar 22 is two inches shorter than distance Y between side columns 12, 14, and bottom bar guides 26, 28 are located adjacent side columns 12, 14, connector 36 may be placed in the one inch area in each bottom bar guide 26, 28 that bottom bar 22 does not penetrate and engage. Connector 36 may be a bolt, a screw or any other element known in the art which is capable of connecting two elements together for the purpose of forming a stronger connection.

As seen in at least FIGS. 1, 2, and 6, bottom bar 22 has a width W less than distance Y between side columns 12, 14, and more preferably between 1 inch and 6 inches less than distance Y. While less than distance Y, it should be appreciated by those having ordinary skill in the art, that width W of bottom bar 22 should be sufficient to engage bottom bar guides 26, 28, i.e. greater than distance X between the bottom bar guides 26, 28, in order to achieve the requisite wind load resistance when door panel 16 is in at least the substantially closed position.

In order to engage bottom bar 22 with bottom bar guides 26, 28, and since width W of bottom bar 22 is less than distance Y between side columns 12, 14, in the preferred embodiment bottom bar guides 26, 28 should be disposed between side columns 12, 14. Disposing bottom bar guides 26, 28 between side columns 12, 14 does, however, expose bottom bar guides 26, 28 to impacts from objects, vehicles, machines, or the like that pass through opening 20. In order to prevent damage to bottom bar guides 26, 28 from such impacts, at least one face 36, and more preferably at least two faces 36, 38, of bottom bar guides 26, 28 may be angled with respect to a plane defined by door panel 16 or an edge of opening 20 in order to deflect any impacts in order to protect bottom bar guides 26, 28. Examples of angled faces 40, 42 which may be utilized can be found in FIGS. 3, 4, 7, and 8. While angled faces 40, 42 are described as being angled with respect to door panel 16, it should be appreciated by those having ordinary skill in the art that the purpose of "angling" the faces is to provide a surface which may deflect objects that may impact bottom bar guides 26, 28 which are passing through the opening in either direction.

It is contemplated by the invention that in addition to or in the alternative to being angled, faces 40, 42 may be made of a resilient pliable material capable of deforming and giving upon impact to protect the impacting object and bottom bar guides 26, 28. While any material may be used, examples include a foam or plastic face attached to or formed as part of bottom bar guides 26, 28 so as to allow for a rigid, unyielding interior, while providing an angled or unangled pliable face or portion which can receive an impact and reform while protecting the interior of bottom bar guides 26, 28.

Figure 9:
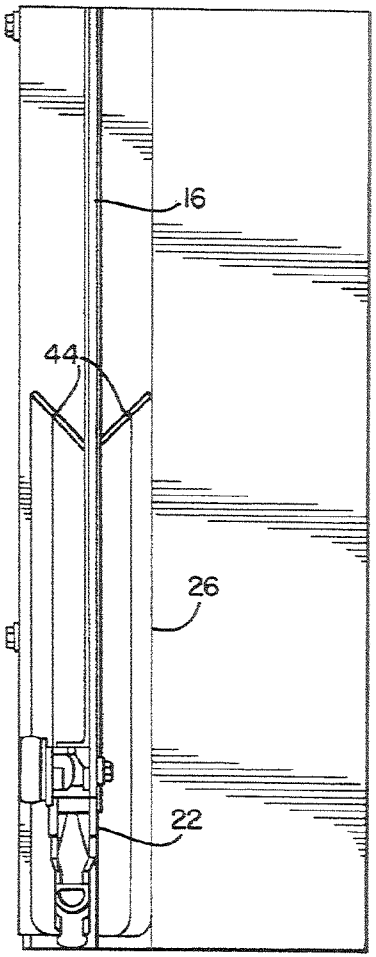
FIG. 9 is a cross-sectional view taken along the line A-A in FIG. 6.

In order to facilitate engage with bottom bar 22, a top portion 44 of each of bottom bar guide 26, 28 may be angled outward from door panel 16 and bottom bar 22, a seen in FIGS. 5 and 9 which are cross-sections along line A-A in FIGS. 2 and 6, respectively. Angling top portion 44 of bottom bar guides 26, 28 outward from door panel 16 and bottom bar 22 creates a greater area for "capturing" or "engaging" bottom bar 22 a door panel is closing, thereby insuring bottom bar guides 26, 28 engage bottom bar 22 in channel 38.

While bottom bar 22 may directly engage bottom bar guides 26, 28 when door panel 16 is in at least a substantially closed position, in order to further facilitate engagement of bottom bar 22 and bottom bar guides 26, 28, bottom bar 22 may include at least one end tab 46 or 48 extending horizontally from at least one edge 50 or 52 for engaging bottom bar guides 26, 28. As seen, for example, in FIGS. 1 and 2, at least one end tab 46, 48 may extend horizontally from at least two edges 50, 52. End tabs 46, 48 should be of sufficient stiffness to withstand external forces, such as high gusts of wind, and therefore may preferably be made of a stiff material, such as rigid steel or hard plastic, however it should be appreciated by those having ordinary skill in the art that tabs 46, 48 may be made of flexible materials. Making tabs 46, 48 from a flexible material may increase the disengage-ability of the bottom bar and tabs from the bottom bar guide stops should the bottom bar or door panel be impacted. It is also contemplated that tabs stiffer than the bottom bar may be utilized to facilitate the strongest possible wind lock.

In embodiments where bottom bar 22 includes end tabs 46, 48, it is advantageous to limit engagement between bottom bar 22 and bottom bar guides 26, 28 to only end tabs 46, 48. In a preferred embodiment, the thickness of end tabs 46, 48 may be substantially similar to the thickness of door panel 16. Limiting engagement in such embodiments to only end tabs 46, 48 may allow for channel 38 which receives bottom bar 22, and therefore bottom bar guides 26, 28, to be smaller with respect to opening 20—allowing channel 38 to be substantially identical in width to path 30. Limiting engagement to only end tabs 46, 48 also insures a tight seal between bottom bar 22 and bottom bar guides 26, 28 inasmuch as it eliminates the possibility that a variation in thickness between the core 54 of bottom bar 22 and end tabs 46, 48 affect the wind load resistance of door assembly 10 when door panel 16 is in a substantially closed position.

It is further contemplated by the invention that the end tabs may be made of a thickness greater than door panel 16 but less than bottom bar 22. Utilizing end tabs of such a thickness insures that the end tabs do not engage side columns 12, 14 during, for example, the opening or closing or any re-alignment sequences, as the tabs may be sized so as not to fit within any opening accepting door panel 16. Sizing any end tabs to have a thickness smaller than bottom bar 22 and adjusting bottom bar guides 26, 28 and path 30 insures that bottom bar 22 does not engage bottom bars 26, 28, insuring a proper wind lock when door panel 16 is in a substantially closed position.

As described above, width W of bottom bar 22 and end tabs 46, 48 should be less than distance Y between side columns 12, 14, and preferably about 1 inch less with core 54 of bottom bar 22 being about 6 inches less. Since the combined width W of bottom bar 22 and end tabs 46, 48 is less than distance Y between side columns 12, 14, and as should be appreciated by those having ordinary skill in the art, end tabs 46, 48 may be made more rigid than known end tabs of known end tabs bottom bars, thereby substantially increasing the wind load resistance of door assembly 10 when end tabs 46, 48 are engaged with bottom bar guides 26, 28.

The alignment and engagement of bottom bar 22 having end tabs 46, 48 with bottom bar guides 26, 28 can be seen in FIGS. 4 and 8. As seen in FIG. 4, as bottom bar 22 approaches bottom bar guide 26, end tab 46 substantially aligns with channel 38 (as discussed above, in order to accommodate for variation in the location of end tab 46, the top portion 44 may be angled outward from bottom bar to facilitate alignment). As door panel 16 is lowered to at least a substantially closed position, as seen in FIG. 8, end tab 46 engages bottom bar guide 26, being guided and locked within channel 38, forming a substantially stronger wind lock for door assembly 10.

In order to further facilitate alignment, in a preferred embodiment, the weight of bottom bar 22 should be centered in an area substantially co-planer with door panel 16. Centering the weight of bottom bar 22 in an area of the bottom bar that is substantially co-planar with door panel 16 helps bottom bar 22, and if included end tabs 46, 48, maintain a substantially vertical alignment, enhancing the engagement between bottom bar 22 and bottom bar guides 26, 28. While top portions 44 of each of the bottom bar guides 26, 28 will still capture bottom bar 22 and/or end tabs 46, 48 if the weight distribution of bottom bar 22 is such that it reaches bottom bar guides 26, 28 at an angle, centering the weight of bottom bar 22 under door panel 16 insures that bottom bar 22 and/or end tabs 46, 48 will engage bottom bar guides 26, 28.

The above-described embodiments of the present invention are intended to be examples only. Alterations, modifications and variations may be effected to the particular embodiments by those of ordinary skill in the art without departing from the scope of the invention, which is defined by the claims appended hereto.

What is claimed is:

1. A door assembly having a flexible door panel wound and unwound on a drum to selectively block or permit access through an opening, the flexible door panel having a stiffness, a width, and a length to permit and prohibit access through the opening, the door assembly comprising:

side columns disposed on opposite sides of the opening, the side columns extending vertically a distance along a portion of the opening and engaging a marginal edge of the flexible door panel to guide the flexible door panel during vertical movement as the flexible door panel opens and closes the opening;

a bottom bar attached to a leading edge of the flexible door panel, the bottom bar having a greater stiffness than the flexible door panel and a narrower width than a distance between the side columns; and, bottom bar guides being disposed proximate a lower portion of the opening, the bottom bar guides including a channel and being configured to engage a portion of the bottom bar, such that the portion of the bottom bar is engaged by the bottom bar guides within the channel only when the flexible door panel is located in at least a partially closed position, wherein a top portion of each of the bottom bar guides is angled outward from the channel.

2. The door assembly of claim 1 wherein the bottom bar guides extend vertically a desired distance, said desired distance being less than the vertical distance of the side columns.

3. The door assembly of claim 2 wherein each of the bottom bar guides extend vertically a distance less than or equal to twenty-four (24) inches.

4. The door assembly of claim 1 wherein the bottom bar guides are attached to a surface forming a lower boundary of the opening.

5. The door assembly of claim 1 wherein the bottom bar guides are attached to the side columns.

6. The door assembly of claim 1 wherein the bottom bar guides each include at least one face angled with respect to a plane defined by the flexible door panel for deflecting impacts from objects passing through the opening in a first direction.

7. The door assembly of claim 6 wherein the bottom bar guides each includes at least a second face angled with respect to the plane defined by the flexible door panel for deflecting impacts from objects passing through the opening in an opposite direction.

8. The door assembly of claim 1 further comprising a connector for enhancing rigidity of the bottom bar guides.

9. The door assembly of claim 1 wherein the width of the bottom bar is at least one inch less than the distance between the side columns.

10. The door assembly of claim 9 wherein the width of the bottom bar is at least six inches less than the distance between the side columns.

11. The door assembly of claim 1 wherein the bottom bar includes at least one end tab extending horizontally from at least one edge.

12. The door assembly of claim 11 wherein the bottom bar includes at least one end tab extending horizontally from at least two edges.

13. The door assembly of claim 12 wherein the width of the bottom bar and end tabs is narrower than a distance between the side columns.

14. The door assembly of claim 13 wherein the at least one end tab extending horizontally from the at least two edges of the bottom bar are the only portion of the bottom bar which engage the bottom bar guides.

15. The door assembly of claim 13 wherein the width of the bottom bar and end tabs is at least one inch less than the distance between the side columns.

16. The door assembly of claim 11 wherein the at least one end tab is made of metal.

17. The door assembly of claim 11 wherein the at least one end tab is made of hard plastic.

18. The door assembly of claim 1 wherein the flexible door panel is made of rubber.

19. The door assembly of claim 1 wherein the bottom bar guides include at least one portion more flexible than another portion of the bottom bar guides.

20. A method for improving wind load resistance of a flexible door panel wound and unwound from a drum to permit and prohibit access to an opening, the method comprising the steps of:

disposing at least two vertical guides on opposite sides of the opening;

engaging the flexible door panel with the vertical guides as the flexible door panel moves between the opened and closed position;

attaching a bottom bar having a stiffness greater than, and a width less than, the flexible door panel, across a leading edge of the flexible door panel;

disposing at least one bottom bar guide proximate a lower portion of the opening, the bottom bar guide including a channel;

extending at least one end tab horizontally from at least one end of the bottom bar and, engaging and guiding a portion of the bottom bar within the channel of the at least one bottom bar guide when the flexible door panel is in at least a partially closed position, wherein the at least one end tab extending horizontally from the at least one end of the bottom bar is the portion of the bottom bar that engages at least one of the bottom bar guides when the flexible door panel is in at least a partially closed position.

* * * * *